US006952896B2

(12) United States Patent
Davis

(10) Patent No.: US 6,952,896 B2
(45) Date of Patent: Oct. 11, 2005

(54) GUNSTOCK INCORPORATING A STORAGE MAGAZINE

(75) Inventor: William A. Davis, Fair Oaks, CA (US)

(73) Assignee: Speedfeed Acquisition Corp., Jacksonville Beach, FL (US)

( * ) Notice: Subject to any disclaimer, the term of this patent is extended or adjusted under 35 U.S.C. 154(b) by 0 days.

(21) Appl. No.: 10/757,081

(22) Filed: Jan. 14, 2004

(65) Prior Publication Data

US 2005/0183315 A1 Aug. 25, 2005

(51) Int. Cl.[7] ..... F41C 23/00
(52) U.S. Cl. ..... 42/71.01
(58) Field of Search ..... 42/71.01

(56) References Cited

U.S. PATENT DOCUMENTS

| | | | |
|---|---|---|---|
| 746,859 | A | 12/1903 | Marble |
| 1,099,992 | A | 6/1914 | Micke |
| 1,517,420 | A | 12/1924 | Fritz |
| 1,526,847 | A | 2/1925 | Fritz |
| 1,734,852 | A | 11/1929 | Frampton et al. |
| 2,375,106 | A | 5/1945 | Holcomb |
| 2,476,355 | A | 7/1949 | Brown |
| 2,495,977 | A | 1/1950 | Madsen |
| 3,638,344 | A | 2/1972 | Wagner et al. |
| D286,669 | S | 11/1986 | Ballard et al. |
| 4,850,127 | A | 7/1989 | Davis et al. |
| 5,755,055 | A | 5/1998 | Thompson et al. |
| 5,813,157 | A | 9/1998 | Scott et al. |
| 6,012,246 | A | 1/2000 | Robinson et al. |
| 6,256,921 | B1 | 7/2001 | Howard et al. |
| 6,418,656 | B1 | 7/2002 | Christiansen |
| 6,427,372 | B1 | 8/2002 | Howard et al. |
| 6,598,329 | B1 * | 7/2003 | Alexander ..... 42/71.01 |
| 6,829,855 | B2 * | 12/2004 | Seifert ..... 42/90 |

* cited by examiner

*Primary Examiner*—Michael J. Carone
*Assistant Examiner*—Troy Chambers
(74) *Attorney, Agent, or Firm*—Thomas C. Saitta

(57) ABSTRACT

A gunstock incorporating one or more storage magazines for temporarily storing and retaining ammunition for easy access, the ammunition having a generally flat or recessed nose such as found for example in shotgun shells. The magazine has a port allowing insertion and removal of the shell and a biasing means whereby a single or multiple shells is pushed forward such that the recessed nose abuts against a projection member. The junction between the magazine bore and the magazine port is configured as a cornered edge on the interior side, and the distance from the cornered edge to the projection member is determined as a function of the ammunition to be stored, such that with a shell disposed against the projection member, the cornered edge will be located at least halfway up the annular brass base of the shell. In addition, the gunstock is provided with a pistol grip, which provides an improved means for grasping and holding the weapon while ammunition is being removed and loaded.

16 Claims, 2 Drawing Sheets

GUNSTOCK INCORPORATING A STORAGE MAGAZINE

BACKGROUND OF THE INVENTION

This invention relates generally to a gunstock or butt incorporating a magazine for storage of ammunition, and more particularly to such a gunstock wherein the magazine is adapted to facilitate delivery of the ammunition into the user's hand when desired. Even more particularly, the invention relates to such a gunstock wherein the ammunition stored and delivered is of a type having a relatively flat forward nose, such that a rimmed and recessed nose configuration is presented, such as for example a shotgun shell.

Many firearms are available that incorporate a magazine capable of feeding ammunition directly into the chamber of a weapon for firing. Among these are found firearms with detachable magazines or clips and firearms with integral magazines. The key advantage presented by such magazines is the ability to rapidly reload the weapon for firing successive rounds after the earlier round is fired.

Firearm weapons with integral magazines generally require that the magazine be reloaded one round at a time once the initial store of ammunition is exhausted. Alternatively, single rounds are fed directly into the receiver by hand in order to maintain continuous firing. Typical of weapons with integral magazines is the pump shotgun, whose magazine, due to the size of the shotgun shell, cannot accommodate large amounts of spare ammunition. In situations where numerous rounds must be fired, the user of the weapon often carries spare rounds in pouches or ammunition belts. In many circumstances it is desirable to reduce the delay between the expenditure of the final round of ammunition contained in the integral magazine and the transfer of secondarily stored ammunition into the chamber. Optimally, the reserve shells are presented at the shortest distance from the receiver and in proper orientation to be inserted. It is also considered desirable to enable this operation to be performed with one hand, while retaining the other hand in position ready for firing the weapon.

Furthermore, it is sometimes desirable for the user of the weapon to carry it unloaded while providing the capability of rapid chamber loading. It is also considered desirable to provide rapid access to different types of ammunition that can be utilized in the same firearm, so that the appropriate choice can be made as the target is presented.

In order to provide the above benefits, while retaining the simplicity of an ordinary gunstock, it is desirable to minimize the number of additional parts and to avoid the use of accessory features that must be employed to store the ammunition.

Numerous ammunition storage devices are known which fail to provide the features outlined above. Among these are U.S. Pat. No. 746,859, U.S. Pat. No. 1,099,992, U.S. Pat. No. 1,517,420, U.S. Pat. No. 1,526,847, U.S. Pat. No. 2,495,977, and U.S. Pat. No. 3,638,344.

The best solution heretofore to the above referenced problems is U.S. Pat. No. 4,850,127, the disclosure of which is incorporated herein by reference, which teaches an integral storage magazine or plural magazines incorporated within the butt portion of the gunstock of a firearm, the magazine comprising an elongated bore having an access port located at the forward end of the bore. The port has an inclined ramp surface to facilitate loading and ejection of ammunition. A spring member biased when a shell is in storage further facilitates ejection of the ammunition. A shouldered projection member temporarily abuts the recessed forward end of the ammunition within the bore to retain the ammunition within the bore until desired. To retrieve a shell from the magazine, the shell is pushed slightly rearward to depress the spring and to allow the rim of the shell to clear the projection member. Then the rearward pressure is stopped to allow the spring to push the shell forward and out of the bore into the user's hand. The bore is preferably of sufficient length to allow for storage of multiple shells, extending to the gun butt. Multiple bores may be provided in the gunstock.

It has been ascertained however, that the design of the gunstock as presented in U.S. Pat. No. 4,850,127 can be improved upon to address several problems. For example, it has been found that there is a tendency for stored shells to fall from the storage magazine upon firing due to recoil forces or upon encountering a strong striking force. An improved construction for the forward end of the magazine bore improves upon the retention ability of the magazine during firing recoil and general handling, insuring that shells stored in the magazine are not inadvertently ejected. Thus, it is an object of this invention to provide an improved gunstock incorporating a magazine for storing ammunition.

SUMMARY OF THE INVENTION

In general, the invention is a gunstock incorporating one or more storage magazines for temporarily storing and retaining ammunition for easy access, wherein the storage magazine is provided with an improved structure, the ammunition having a generally flat or recessed nose such as found for example in shotgun shells. The magazine has a port allowing insertion and removal of the shell and a biasing means whereby a single or multiple shells is pushed forward such that the recessed nose abuts against a projection member. Release of the shell is accomplished by the user forcing the shell backward sufficient distance for the nose to clear the projection member, with the biasing member assisting in ejecting the shell from the magazine.

The improvement to known gunstocks of this type lies in the location and configuration of the rear region of the access port. The junction between the magazine bore and the magazine port is configured as a cornered edge on the interior side, and the distance from the cornered edge to the projection member is determined as a function of the ammunition to be stored, such that with a shell disposed against the projection member, the cornered edge will be located at least halfway up the annular brass base of the shell. In addition, the gunstock is provided with a pistol grip, which provides an improved means for grasping and holding the weapon while ammunition is being removed and loaded.

DETAILED DESCRIPTION OF THE INVENTION

With reference to the drawings, the invention will now be described in detail with regard for the best mode and the preferred embodiment. While the invention is illustrated primarily with reference to a shotgun, the novel features of the invention have broader application to numerous types of weapons or firearms where the ammunition is similarly configured to that illustrated. The ammunition or shells may be live fire, blank or reduced load for training purposes. In general, the invention is a gunstock incorporating a storage magazine for temporarily storing and retaining ammunition for easy access, wherein the storage magazine is provided with an improved structure, and wherein the ammunition is of a type having a generally flat or recessed nose, such as for example a shotgun shell.

Figure 1:
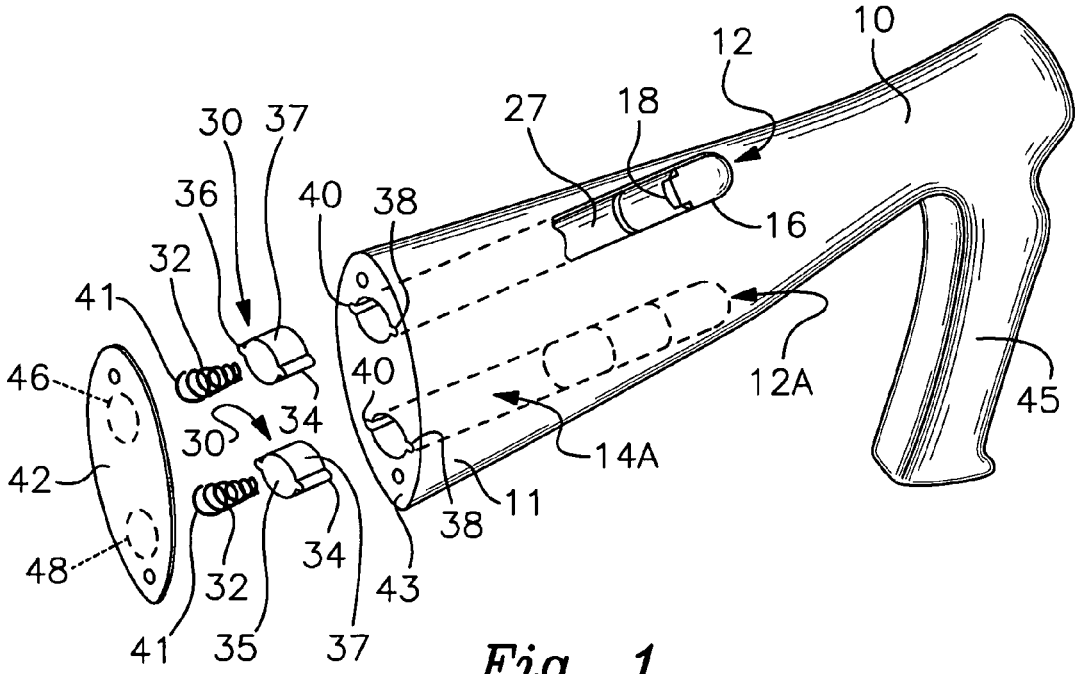
FIG. 1 is an exploded perspective view, with portions broken away, of a gunstock embodying the storage magazine of the invention.
Figure 2:
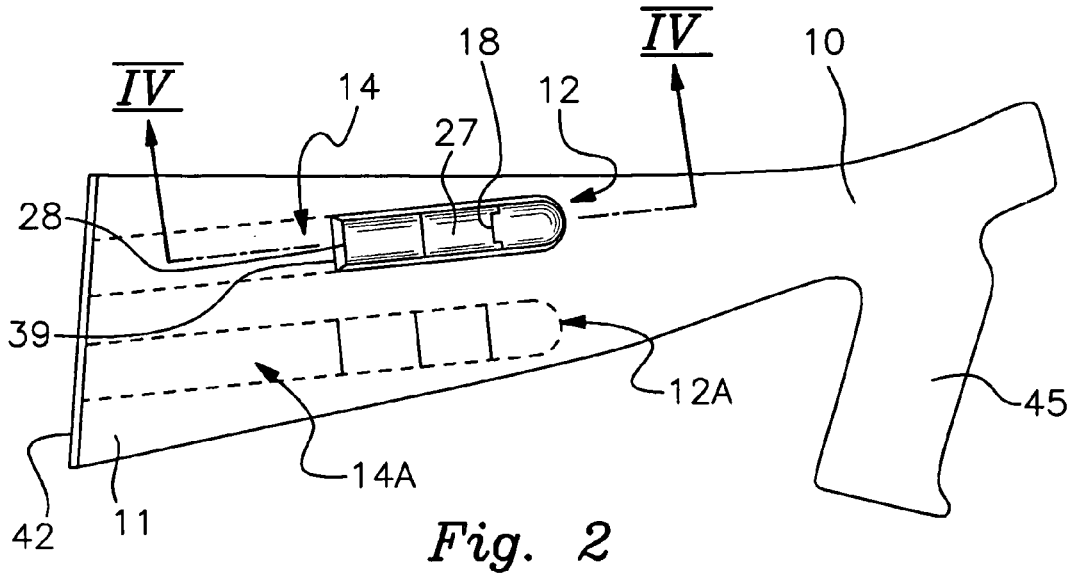
FIG. 2 is a side elevation of the assembled gunstock of FIG. 1, with certain portions deleted and certain features shown in phantom line.

FIG. 1 shows a shotgun or weapon gunstock 10 that comprises a buttstock 11 and storage magazines 14 and 14A with uncovered or open access ports 12 and 12A respectively. While two storage magazines are illustrated, it is understood that any number of magazines may be incorporated into the gunstock 10. The magazines 14 and 14A extend reward within buttstock 11. The forward part of the gunstock 10 is adapted to be attached to a shotgun receiver and barrel (not shown), or similar type weapon, in known manner. As shown, the gunstock 10 is preferably provided with a downward extending pistol grip 45. The cylindrical cross-sectional diameter of the magazines 14 and 14A are sized to accommodate the diameter of the contained ammunition or shell 21. A circular cross-sectional shape is preferred, but other configurations may be found suitable.

Figure 4:
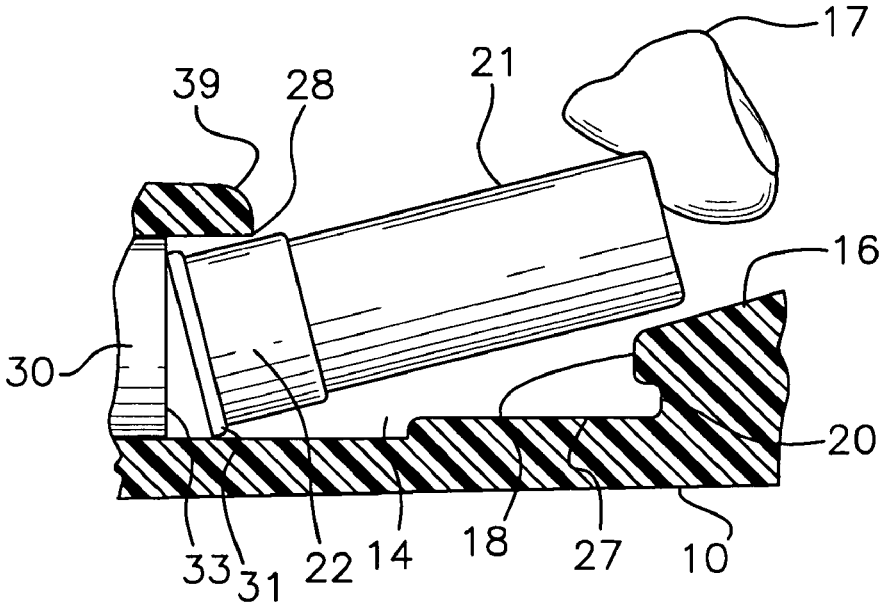
FIG. 4 is an enlarged view of a portion of FIG. 3, showing one mode of operation of the invention.

As shown best in FIG. 4, the forward end of the magazine 14 and magazine port 12 are configured to provide for slidable insertion and selectively releasable retention of stored ammunition 21. Beginning at the forward edge of the magazine 14 and port 12, a ramped surface finger groove 16 is provided to allow ready access by the user's finger 17 to the forward end 19 of the stored ammunition 21. Although not essential, it is considered desirable to provide a relatively wide cross-section for the finger groove 16 in order to accommodate the user's finger 17 when gloves are worn. The precise angle formed between the ramp surface of the groove 16 and the centerline of the magazine 14 is not essential, although it is desirable to provide a relatively oblique, ranging approximately between 120 to 160 degrees, to simplify access to the ammunition 21. The ramp surface of groove 16 is inclined upward and toward the forward end of the magazine 14.

Figure 3:
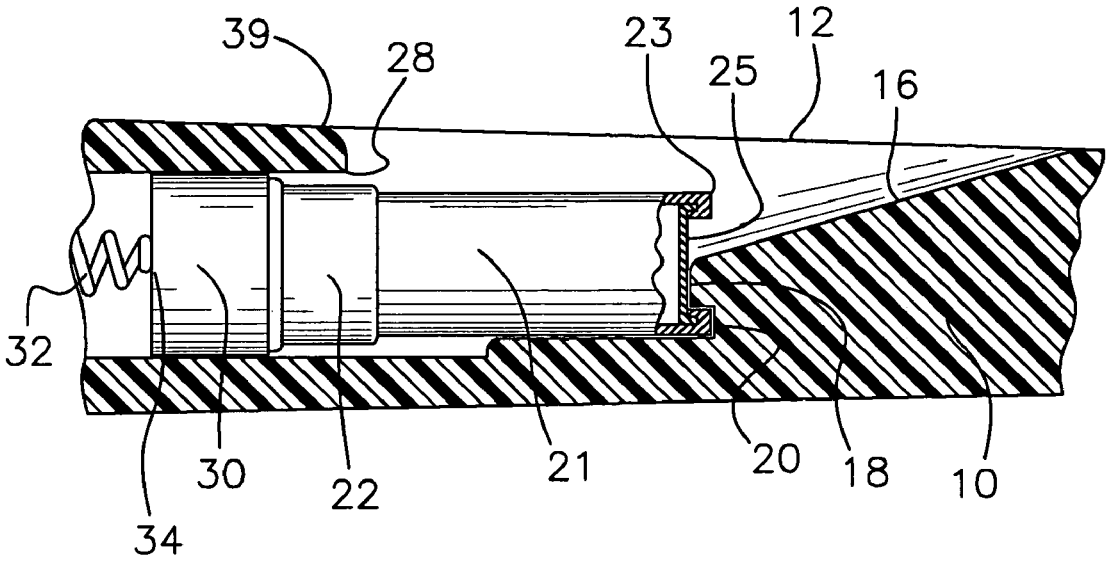
FIG. 3 is an enlarged view of a portion of FIG. 2 taken generally in vertical cross-section along line IV—IV, with an inserted round of ammunition shown with portions of the nose broken away and in cross-section.

Temporary maintaining means are provided at the rearward edge of the finger groove 16 to cooperatively interact with the forward end or recessed nose 25 of the ammunition 21, and comprises a projection member 18 that interlocks with a forward portion 19 of the stored ammunition 21. The recessed nose 25 of the ammunition 21 is biased against the projection member 18 with a follower member 30 and spring 32 that urge the ammunition 21 in the forward direction. The recessed nose 25 of the shell 21 has a circumferential rim 23. When the shell is in the forwardly biased interlocked position, as shown in FIG. 3, the rim 23 abuts the arcuate recessed region 20 formed by the magazine wall 27 and the projection member 18. Slight modifications may be required to adapt the projection member 18 to ammunition 21 having slightly different forward configurations.

In order to better retain the ammunition 21 when the gunstock 10 is subjected to shock forces, such as are encountered when the weapon is fired or struck against a solid object, the configuration of the rearward edge 39 of the magazine port 12 is such that the ammunition 21 is better retained than in earlier versions. The shock of recoil may result in compression of the spring member 32, such that the ammunition 21 is free to move in the rearward direction. When this occurs, the forward end 19 of the ammunition 21 may clear the projection member 18, such that the biased spring 32 will inadvertently eject the shell 21. To address this problem it is essential that the rearward edge 39 of the magazine port 12 be properly distanced from the projection member 18 and arcuate recessed region 20, and that the rearward edge 39 have an interior cornered edge 28, preferably a right angle corner, rather than a beveled or radiused edge at the junction on the interior side between the port 12 and the bore forming the magazine 14. The proper distance from the rearward edge 39 of port 12 to the projection member 18 is a function of the length of the shell 21 being retained. The rear portion 31 of a shell 21 comprises an annular metal component often referred to as the brass or base 22, which is usually composed of brass, and it is necessary that the cornered edge 28 of the rearward region 39 of the port 12 extend in the forward direction equal to or beyond the midpoint of the annular base 22 when the shell 21 is stored within the magazine 14. Thus, the distance from the projection member 18 to the cornered edge 28 on the interior side of the rearward edge 39 of the port 12 must be equal or less than the distance from the midpoint of the base 22 of the ammunition 21 to the nose 25 of the ammunition 21.

The provision of a pistol grip 45 further improves the operation of the weapon, as the pistol grip 45 provides a means to safely and securely grasp the weapon while the ammunition 21 is removed from the magazine 12 and loaded into the firing chamber of the weapon. In earlier versions where no pistol grip is incorporated into the gunstock, grasping and holding the weapon during the retrieval and loading operation is awkward.

The magazine 14 preferably extends rearward through the buttstock 11 such that a plurality of shells or ammunition 21 may be stored therein. Biasing pressure is provide from the rearward portion of the magazine 14 by spring member 32 in order to bias the ammunition 21 forward against the projection member 18. While shown as a helical spring, the spring member 32 may comprise any means for providing forward bias to the ammunition 21. In addition, the bias from spring 32 causes the round of ammunition 21 to be readily ejected from the magazine 14 upon demand by the user. A follower member 30 is disposed between the spring 32 and the rearward portion of the ammunition 21. The spring 32 has a rearward end 41 that impacts upon a plate 42 mounted onto the rear of the buttstock 11. The plate 42 may incorporate recessed regions 46 and 48 to receive the rearward end 41 of the springs 32. The follower member 30 may be constructed of molded plastic and is designed to conform generally to the cross-section of the magazine 14. The forward end 33 of the follower member 30 will, during the operation of the invention, contact the rearward surface 31 of a single stored shell 21 or the rearmost stored shell 21 where plural shells 21 are stored and transmit a force to urge the forwardmost shell 21 in the magazine 14 against the projection member.

Additional benefits are obtained by providing indexing projections 34 and 36 on the outer surface 37 of follower member 30. Each projection 34 and 36 is designed to fit within a complimentary groove 38 and 40 provided in the magazine wall 27. The grooves 38 and 40 should terminate short of the rearward edge 39 of the magazine port 12 in order to retain the follower member 30 within the magazine 14 when no shells 12 are being stored. It is also desirable that the rearward end 35 of the follower member 30 provides a recessed region capable of accepting the forward end of the spring 32. This reduces the amount of the magazine 14 occupied by the follower member 30 and spring 32 when the magazine 14 is fully loaded with a plurality of shells 21.

A preferred embodiment of the invention as illustrated incorporates two magazines 14 and 14A located on opposite sides of the gunstock 10. Alternatively, plural magazines may be disposed on the same side of the gunstock 10. The detailed description of the structure of magazine 14 above is also to be considered descriptive of magazine 14A or additional magazines.

For magazines 14 designed to accommodate a single shell 21, the ammunition maintaining means may be simplified by substituting an elastomeric or rubber plug, or a simple leaf or coil spring, in place of spring 32 to bias the single shell 21 in the forward direction against the projection member 18. While not preferred, it is also possible to provide an unyielding rear wall to the magazine 14, with the length of the magazine 14 sized to be slightly smaller than the length of the ammunition 21 to be stored, such that the rim 23 may be forced onto the projection member 18 and forceably removed when needed.

It is understood and contemplated that equivalents and substitutions for certain elements set forth above may be obvious to those skilled in the art, and therefore the true scope and definition of the invention is to be as set forth in the following claims.

I claim:

1. A gunstock comprising an ammunition storage magazine releasably retaining at least one round of ammunition, said ammunition having a recessed nose and an annular metal base;

an uncovered magazine port allowing access to said magazine for insertion and removal of said ammunition from said magazine, said magazine port having a rearward edge with a non-beveled and non-radiused interior cornered edge;

a biasing member disposed within said magazine; and a projection member, whereby said biasing member forces said recessed nose of said ammunition against said projection member to temporarily retain said ammunition within said gunstock;

wherein said interior cornered edge extends at least halfway on said annular metal base of said ammunition abutted against said projection member.

2. The gunstock of claim 1, wherein said interior cornered edge defines a junction between said magazine port and said magazine.

3. The gunstock of claim 1, wherein said cornered edge is a right angle.

4. The gunstock of claim 1, further comprising a pistol grip, said pistol grip providing secure grasping means for said gunstock while said ammunition is inserted and removed.

5. The gunstock of claim 1, comprising plural ammunition storage magazines.

6. A gunstock comprising an ammunition storage magazine releasably retaining at least one round of ammunition, said ammunition having a recessed nose and an annular metal base with a midpoint;

an uncovered magazine port allowing access to said magazine for insertion and removal of said ammunition from said magazine, said magazine port having a rearward edge with a non-beveled and non-radiused interior cornered edge;

a biasing member disposed within said magazine; and a projection member, whereby said biasing member forces said recessed nose of said ammunition against said projection member to temporarily retain said ammunition within said gunstock;

wherein the distance between said interior cornered edge and said projection member is equal to or less than the distance between the midpoint of said annular metal base and said recessed nose of said ammunition abutted against said projection member.

7. The gunstock of claim 6, wherein said interior cornered edge defines a junction between said magazine port and said magazine.

8. The gunstock of claim 6, wherein said cornered edge is a right angle.

9. The gunstock of claim 6, further comprising a pistol grip, said pistol grip providing secure grasping means for said gunstock while said ammunition is inserted and removed.

10. The gunstock of claim 6, comprising plural ammunition storage magazines.

11. A gunstock comprising an ammunition storage magazine releasably retaining at least one round of ammunition, said ammunition having a recessed nose and an annular metal base with a midpoint;

an uncovered magazine port allowing access to said magazine for insertion and removal of said ammunition from said magazine, said magazine port having a rearward edge with a non-beveled and non-radiused interior cornered edge;

a biasing member disposed within said magazine;

a projection member, whereby said biasing member forces said recessed nose of said ammunition against said projection member to temporarily retain said ammunition within said gunstock;

and a pistol grip, said pistol grip providing secure grasping means for said gunstock while said ammunition is inserted and removed.

12. The gunstock of claim 11, wherein said interior cornered edge defines a junction between said magazine port and said magazine.

13. The gunstock of claim 11, wherein said cornered edge is a right angle.

14. The gunstock of claim 11, wherein said interior cornered edge extends at least halfway on said annular metal base of said ammunition abutted against said projection member.

15. The gunstock of claim 11, wherein the distance between said interior cornered edge and said projection member is equal to or less than the distance between the midpoint of said annular metal base and said recessed nose of said ammunition abutted against said projection member.

16. The gunstock of claim 11, comprising plural ammunition storage magazines.

* * * * *